US006974426B2

(12) United States Patent
Liang

(10) Patent No.: US 6,974,426 B2
(45) Date of Patent: Dec. 13, 2005

(54) MASSAGING STRUCTURE WITH A BUFFER FUNCTION

(76) Inventor: Ching-Yao Liang, NO. 53, Chung-Hsing St., Hsin-Shih Country, Tainan County (TW)

( * ) Notice: Subject to any disclaimer, the term of this patent is extended or adjusted under 35 U.S.C. 154(b) by 329 days.

(21) Appl. No.: 10/367,452

(22) Filed: Feb. 12, 2003

(65) Prior Publication Data

US 2004/0158180 A1 Aug. 12, 2004

(51) Int. Cl.[7] ..... A61H 15/00
(52) U.S. Cl. ..... 601/99; 601/100; 601/102; 601/116
(58) Field of Search ..... 601/86, 87, 90–94, 601/97–99, 100–103, 107, 108, 111, 115, 601/116, 118, 122, 126

(56) References Cited

U.S. PATENT DOCUMENTS 4,149,531 A * 4/1979 Tanaka et al. ..... 601/102
6,056,707 A * 5/2000 Hayashi ..... 601/99
6,213,962 B1 * 4/2001 Shimizu ..... 601/90
6,224,563 B1 * 5/2001 Nonoue et al. ..... 601/99
6,409,689 B1 * 6/2002 Chen ..... 601/99
6,503,212 B2 * 1/2003 Park ..... 601/158

* cited by examiner

*Primary Examiner*—Danton D. DeMille
*Assistant Examiner*—Quang D. Thanh
(74) *Attorney, Agent, or Firm*—J.C. Patents

(57) ABSTRACT

A massaging structure with a buffer function includes a threaded rod positioned in a frame, and a coil spring respectively provided at an upper end section and a lower end section of the threaded rod. When a moving member of a massaging roller moves to the highest point or to the lowest point of the threaded rod, a micro switch at the highest point and at the lowest point of the threaded rod is contacted by the moving member, turned on and activating a motor to reverse its rotating direction. If the motor stops in case of a disorder, the coil springs can let the moving member jump up and down so that a user may know a disorder happened and correct it. Thus, the threads of the threaded rod and the moving member can be protected from damage.

1 Claim, 3 Drawing Sheets

MASSAGING STRUCTURE WITH A BUFFER FUNCTION

BACKGROUND OF THE INVENTION

1. Field of the Invention

This invention relates to a massaging structure with a buffer function, particularly to one applicable to a massage chair or a massage bed for getting rid of disorder swiftly if it happens, having pragmatic design.

2. Description of the Prior Art

A conventional massage chair or bed generally includes a massaging structure shown in FIG. 1 consisting of a massage roller (B) to produce kneading, scrubbing and squeezing action. The massaging structure has a threaded rod (AO) vertically provided, a moving member (D) threadably engaging the threaded rod (AO) to move up and down for moving together a massage roller (B), and a motor (C) driving the moving member (D) up and down along the threaded rod (AO). The motor (C) is connected electrically with and controlled by two micro switches (C0), (C1) respectively located at an upper end and a lower end of the threaded rod (AO). Then when the moving member (D) moves up to the highest point to touch the micro switch (C0), the motor is to rotate reversely (or counterclockwise) to make the moving member move down. When the moving member (D) reaches the lowest point, it will touch the micro switch (C1), which then activates the motor (C) to rotate normally (or clockwise) to move down the moving member (D). In case the micro switches (C0), (C1) should lose function (or get out of order), the motor (C) could not get a signal from one of the micro switches for reverse rotation, causing the moving member impossible to move reversely and resulting in getting stuck the moving member (D) immovable at the highest point or the lowest point of the threaded rod (AO).

Therefore, the threaded rod (AO) still keeps rotated by the motor (C) and the moving member got still stuck immovable, so the threads of the threaded rod (AO) and the moving member (D) still engage and wear and tear to cause disorder of the massage structure, if a user is not aware of the out-of-order condition of the moving member sticking at the highest or the lower point.

The same disadvantage of a massaging structure is also recognized in the U.S. Pat. Nos. 6,200,282-B1, 6,224,563-B1, 6,071,252, 5,653,679, 6,013,040, 1,638,025, and 5,741,218.

SUMMARY OF THE INVENTION

This invention has been devised to offer a massaging structure with a buffer function not liable to get out of order to improve the disadvantage of the conventional massaging structure described above.

The feature of the invention is coil springs provided to fit around an upper non-threaded and a lower non-threaded section of a threaded rod to make up a buffer function, in order to let the moving member jump up and down without sticking to the threaded rod by means of the coil springs in case of the two micro switches getting out of order. Then a user can easily notice the disorder of the massaging structure and correct it swiftly.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
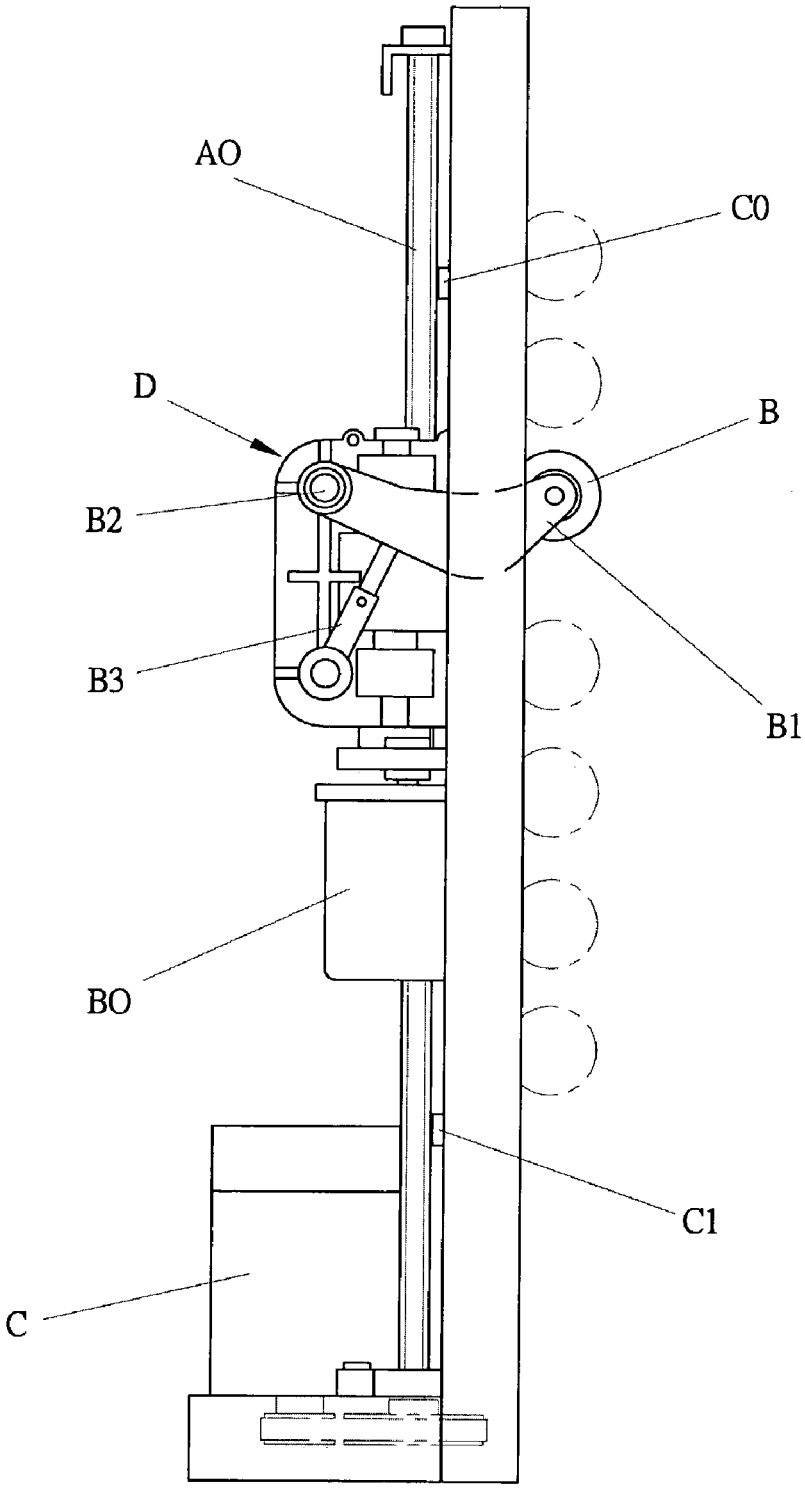
FIG 1 (PRIOR ART)
FIG. 1 is a side view of a conventional massaging structure.

A preferred embodiment of a massaging structure with a buffer function in the present invention, includes a frame 1, a threaded rod 2, a motor 3, two micro switches 10 and 11, a massaging roller 4 and a moving member 40 as main components combined together.

The frame 1 is combined with a massaging chair or bed as integral, or it may be combined with the frame of a massaging chair (or bed) by means of a spring.

The motor 3 is provided for rotating clockwise and counterclockwise the threaded rod 2, which engages with and moves the moving member 40 up and down. Further, micro switches 10 and 11 are provided respectively on the upper side and the lower side of the frame 1, connected to the motor 3. Then the upper micro switch 10 touched and turned on by the moving member 40 moved up to the highest point of the threaded rod 2 may activate the motor 3 to change rotation accordingly from the clockwise to the counterclockwise. The lower micro switch 11 does the contrary action to let the motor 3 change the counterclockwise rotation to the clockwise one. Thus the massaging roller 4 fixed with the moving member 40 may be turned and massage the back of a user by moving up and down action of the moving member 40.

Figure 2:
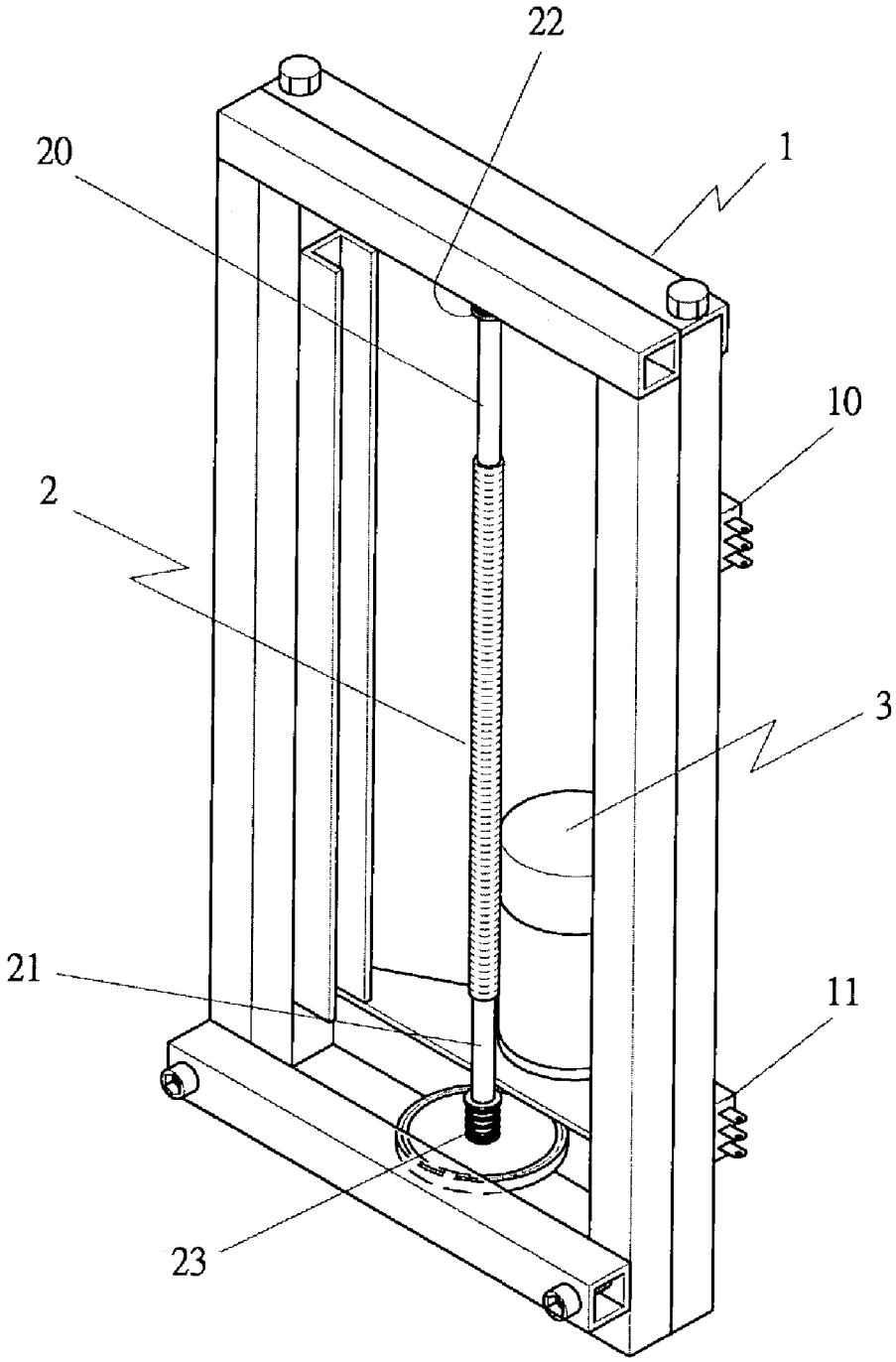
FIG. 2 is a perspective view of a massaging structure in the present invention.
Figure 5:
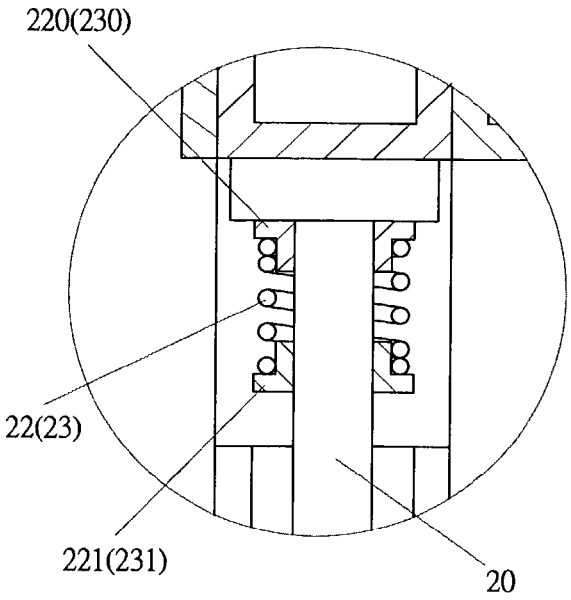
Figure 4:
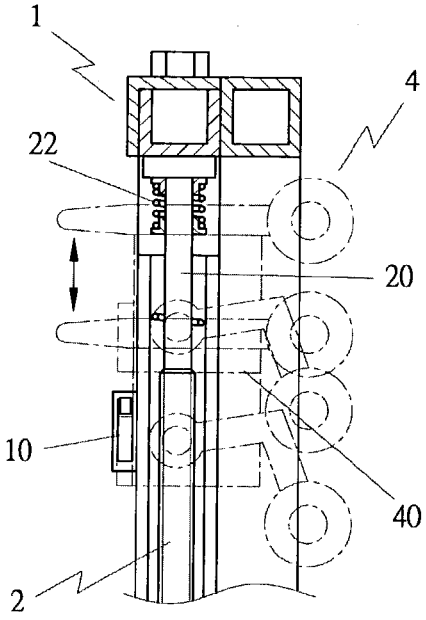
FIG. 4 is a partial cross-sectional view of the massaging structure in an operating condition in the present invention; and, FIG. 5 is a magnified view of the part marked An in FIG. 3.
Figure 3:
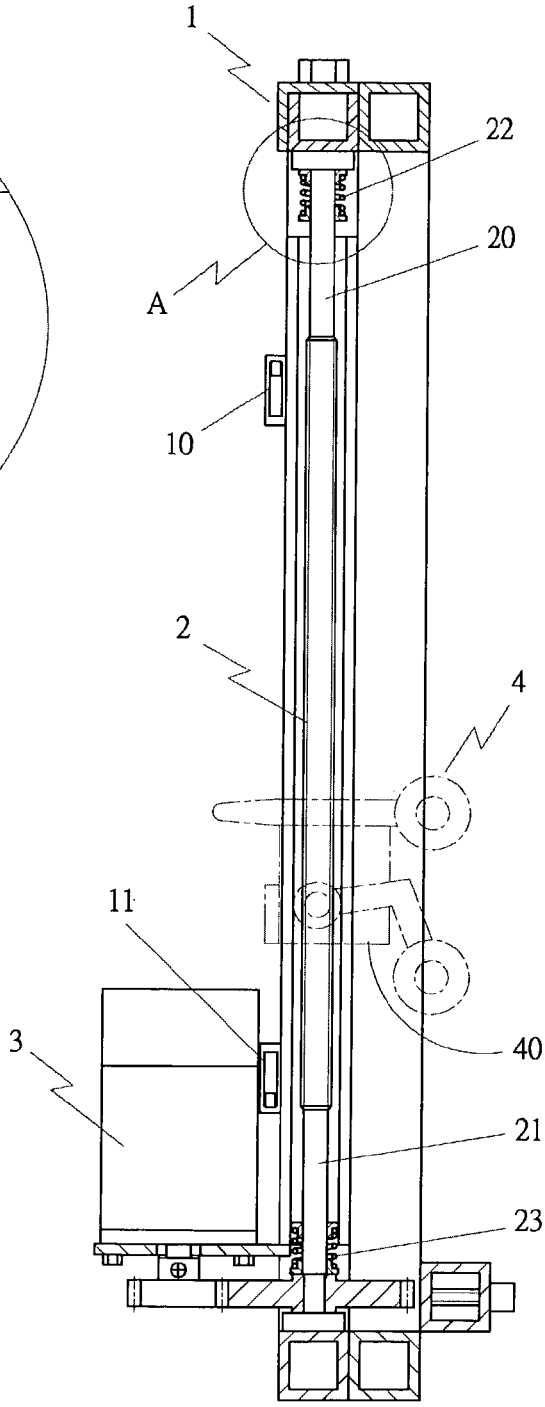
FIG. 3 is a partial side view of the massaging structure in the present invention.

The threaded rod 2 is combined with the frame 1, having an upper end fixed at the upper side of the frame 1 and a lower end fixed at the lower side of the frame 1. Further, the threaded rod 2 is threadably combined with and rotated by the motor 3, as shown in FIG. 2. Then the moving member 40 threadably engaging with the threaded rod 2 may be moved up and down. If the threaded rode 2 is not rotated, the moving member 40 of the massage roller 4 may have a built-in moving source to move up and down along the threaded rod 2. The threaded rod 2 further have non-threaded section 20, 21 in an upper and a lower end portion, and a coil spring 22, 23 respectively fitted around the non-threaded section 20, 21, as shown in FIGS. 3, 4 and 5. Then two spring supporters 220(230) and 221(231) are provided for respectively supporting the coil spring 22, 23 therebetween, limiting the location of the coil springs 22, 23 to hold an extremely good buffer function.

In using the massaging structure with a buffer function in the invention, if the motor 3 stops owing to the disorder of the two micro switches 10, 11 or of the circuit control system, impossible to rotate the threaded rod to move the moving member 40 to reverse its moving direction, the two coil springs 22, 23 can function to be compressed by the moving member 40 to jump up and down as shown in FIG. 4, and the provision of the non-threaded sections 20 and 21, the threads of the threaded rod 2 and of the moving member 40 may not be impaired as the moving member 40 do not stick with the threaded rod 2 by means of the function of the coil springs 22, 23. Thus these components may be protected from damaging and reduced in its wear and tear. Accordingly, a user can notice the disorder by jumping up-and-down action of the moving member 40 and swiftly and properly remove it.

While the preferred embodiment of the invention has been described above, it will be recognized and understood that various modifications may be made therein and the appended claims are intended to cover all such modifications that may fall within the spirit and scope of the invention.

What is claimed is:

1. A massaging structure with a buffer function comprising:

a frame combined with a massaging chair or bed, having a micro switch fixed at an upper side of said frame and another micro switch fixed at a lower side of said frame;

a threaded rod disposed vertically in said frame, said threaded rod having an upper end fixed with the upper side of said frame and a lower end fixed with the lower side of said frame, said threaded rod further having a non-threaded section formed in an upper end section and a lower end section, a coil spring fitting respectively around said two non-threaded sections, each said coil spring positioned between two spring supporters to be limited in its position for holding an extremely good buffer function;

a motor provided to rotate said threaded rod clockwise and counterclockwise and electrically connected with said two micro switches and activated by said micro switches to reverse its rotating direction;

a moving member combined with a massaging roller and threadably engaging with said threaded rod and moved up and down by said threaded rod when said threaded rod is rotated clockwise and counterclockwise by said motor, said moving member touching and turning on one of said micro switches when it reaches the highest point or the lowest point of said threaded rod while moving up or down;

said massaging roller fixed with said moving member, and rotating and massaging the back of a user while moving up and down with said moving member;

and whereby in case of a malfunction of said micro switches or said motor so that said moving member cannot reverse its moving direction, one of said coil springs contacting and being compressed by said moving member to shorten and lengthen its length causing said moving member to jump up and down, thereby allowing the user to be aware that said messaging structure having a malfunction and accordingly correct it, thus threads of said threaded rod and of said moving member can be protected from damaging and reduced in its wear and tear.

* * * * *